US005582293A

United States Patent [19]

Kay

[11] Patent Number: 5,582,293

[45] Date of Patent: Dec. 10, 1996

[54] THREE-DIMENSIONAL DISPLAY AND PACKAGING DEVICE

[76] Inventor: Norman Kay, Soundview La., Sands Point, N.Y. 11050

[21] Appl. No.: 583,311

[22] Filed: Jan. 5, 1996

[51] Int. Cl.[6] ..... B65D 25/10

[52] U.S. Cl. ..... 206/457; 206/459.5; 206/775

[58] Field of Search ..... 206/459.5, 775, 206/776, 778, 779, 782, 783, 486, 488, 457

[56] References Cited

U.S. PATENT DOCUMENTS 2,325,224 7/1943 Bryant, Sr. ..... 206/775 X
3,369,660 2/1968 Hartman ..... 206/776 X
3,946,870 3/1976 Gajer et al. ..... 206/775 X

*Primary Examiner*—Jacob K. Ackun
*Attorney, Agent, or Firm*—Steinberg, Raskin & Davidson, P.C.

[57] ABSTRACT

A product display device having an enclosure member and an insert member situated there within. The enclosure member has opposing front and rear walls with at least the front wall being formed of transparent or translucent material. The insert member has a transparent or translucent display wall situated intermediate the front wall and the rear wall and includes a device for associating the product to be displayed therewith. Graphics are provided on the front, rear and display walls such that the product, when associated with the intermediate display wall, appears to be situated in a three-dimensional display.

20 Claims, 9 Drawing Sheets

THREE-DIMENSIONAL DISPLAY AND PACKAGING DEVICE

BACKGROUND OF THE INVENTION

The present invention relates generally to display devices and, more particularly, to carton-type display devices for various types of products.

National brands companies and retail sellers are constantly seeking more attractive means to package their products to make them more appealable, and therefore more sellable, to consumers. For example, the liquor industry is extremely active in designing new cartons for packaging bottles of liquor in a manner which will appeal to consumers. Often these bottles are accompanied by gifts and premiums, such as glassware.

Retailing of a product is often enhanced by providing attractive packaging and at the same time by providing visibility of the product contained within the packaging. The addition of transparent "windows" in the panels of cartons formed of opaque board material provides visibility of the product. Indeed, some cartons are now formed entirely of transparent plastic material thereby providing complete visibility of the product. Although such packaging systems are well-known, packaging designers are always seeking new and improved packaging designs for various products. The retailing of a product is also facilitated by providing attractive and eye-catching promotional displays for the product and new designs for such displays are also in continuous demand.

OBJECTS AND SUMMARY OF THE INVENTION

It is an object of the present invention to provide new and improved display and packaging devices.

It is another object of the present invention to provide new and improved display and packaging devices for products which provide an appearance that the product is situated in a unified three-dimensional environment.

It is yet another object of the present invention to provide new and improved display and packaging devices which function as carton-type packages for products.

It is still another object of the invention to provide new and improved display devices for promoting products.

In view of achieving these objects, and others, in the device of the present invention, an enclosure member is combined with an insert member situated therein. The enclosure member has opposing front and rear walls, at least the front wall of which is fabricated or formed of a transparent material. The insert member has a display wall which is situated intermediate of the front and rear walls and is also formed of a transparent material. The insert member incorporates means for associating a product with it. Foreground, background and mid-ground interrelated graphics are provided on the front, rear and intermediate display walls respectively such that a product, or its image, when associated with the intermediate display wall, appears to be situated in a unified three-dimensional environment.

In a preferred embodiment of the invention, the display wall of the insert member has an opening in which the product, such as a bottle of liquor or perfume or the like, is held. Graphics provided on the display wall as well as on the front and rear walls, provide a three-dimensional effect so that the bottle or the like appears to be part of a unified three-dimensional scene created by the graphics.

In other embodiments of the invention, the image of a product to be promoted is applied to either the intermediate display wall or the rear wall so that the product image appears to be situated in a unified three-dimensional scene. Such embodiments function as eye-catching promotional display devices for the product.

It is an important and remarkable advantage of the present invention that the graphics which are provided on the front, intermediate display, and rear walls cooperate with each other to create a unified three-dimensional scene and thus, provide an attractive display device for a bottle or other product contained therein, or for the product image.

Other embodiments of the invention incorporate the principal aspects of the embodiment described above, viz., a transparent front wall, a rear wall, an intermediate transparent display wall and related graphics provided on all three walls providing a unified three-dimensional scene, and include, e.g., table-tent type products, dangler products and the like.

BRIEF DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
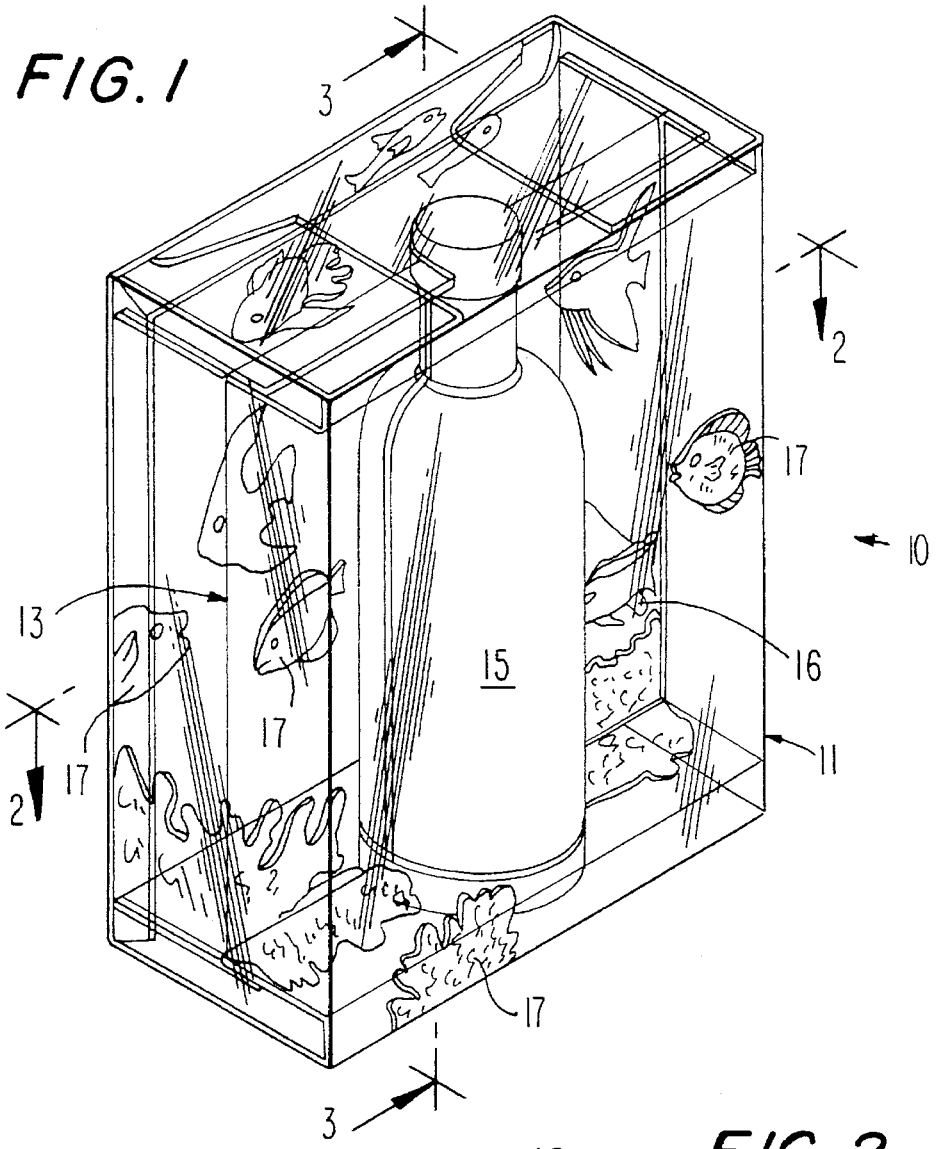
FIG. 1 is a perspective view of one embodiment of a three-dimensional display device in accordance with the invention.
Figure 2:
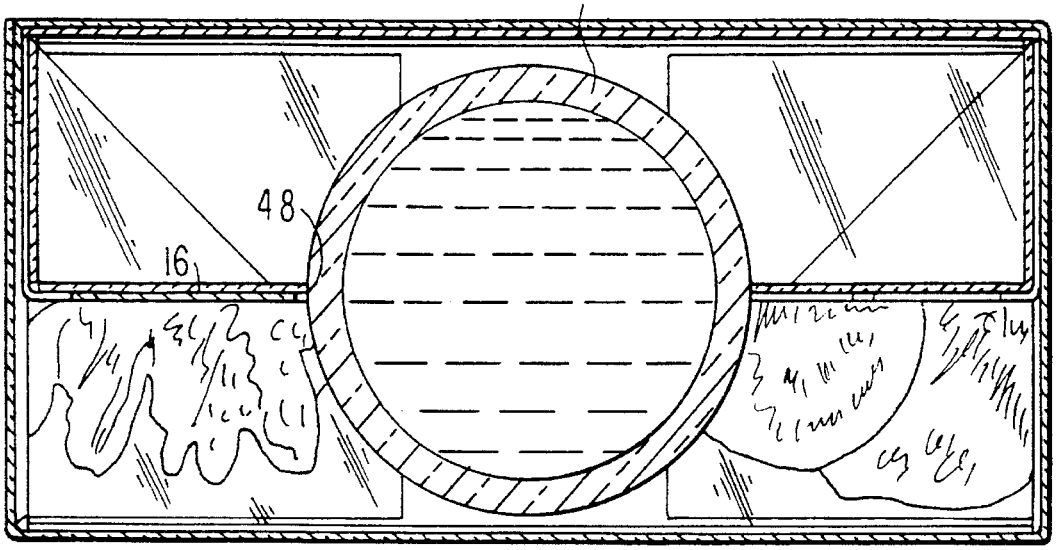
FIG. 2 is a sectional view taken along line 2—2 of FIG. 1.

Referring now to the drawings wherein like reference characters designate identical or corresponding parts throughout the several views, and more particularly to FIGS. 1–7, a display device in accordance with the present invention is designated generally as 10. The device includes a carton-like enclosure member 11 and insert member 13 situated therewithin. The interior of enclosure member 11 is defined by front wall 12 and rear wall 14, both walls in opposing relationship with each other. Generally, at least front wall 12 of the enclosure member 11 is formed of a transparent plastic sheet material. Insert member 13, situated in the interior of enclosure member 11, includes display wall 16 formed of a transparent plastic material located intermediate front wall 12 and rear wall 14. Insert member 13 has product associating means in the form of an opening 48 wherein a product, such as a bottle 15 of liquor, may be associated for display and/or packaging purposes. Foreground, background and mid-ground interrelated graphics 17 are provided on front wall 12, rear wall 14 and intermediate display wall 16 respectively such that the product, when associated with display wall 16, appears to be situated in a mid-ground region of a unitary three-dimensional display.

The invention may be embodied utilizing enclosure members comprising virtually any type of hundreds of folding carton constructions, the choice of which is usually dependent on the product to be packaged. The invention can be embodied in tray style cartons in which solid bottoms are hinged to side and end walls and tube style cartons in which the body of the carton is a sheet of board folded over and glued at its edges to form a sleeve.

Figure 4:
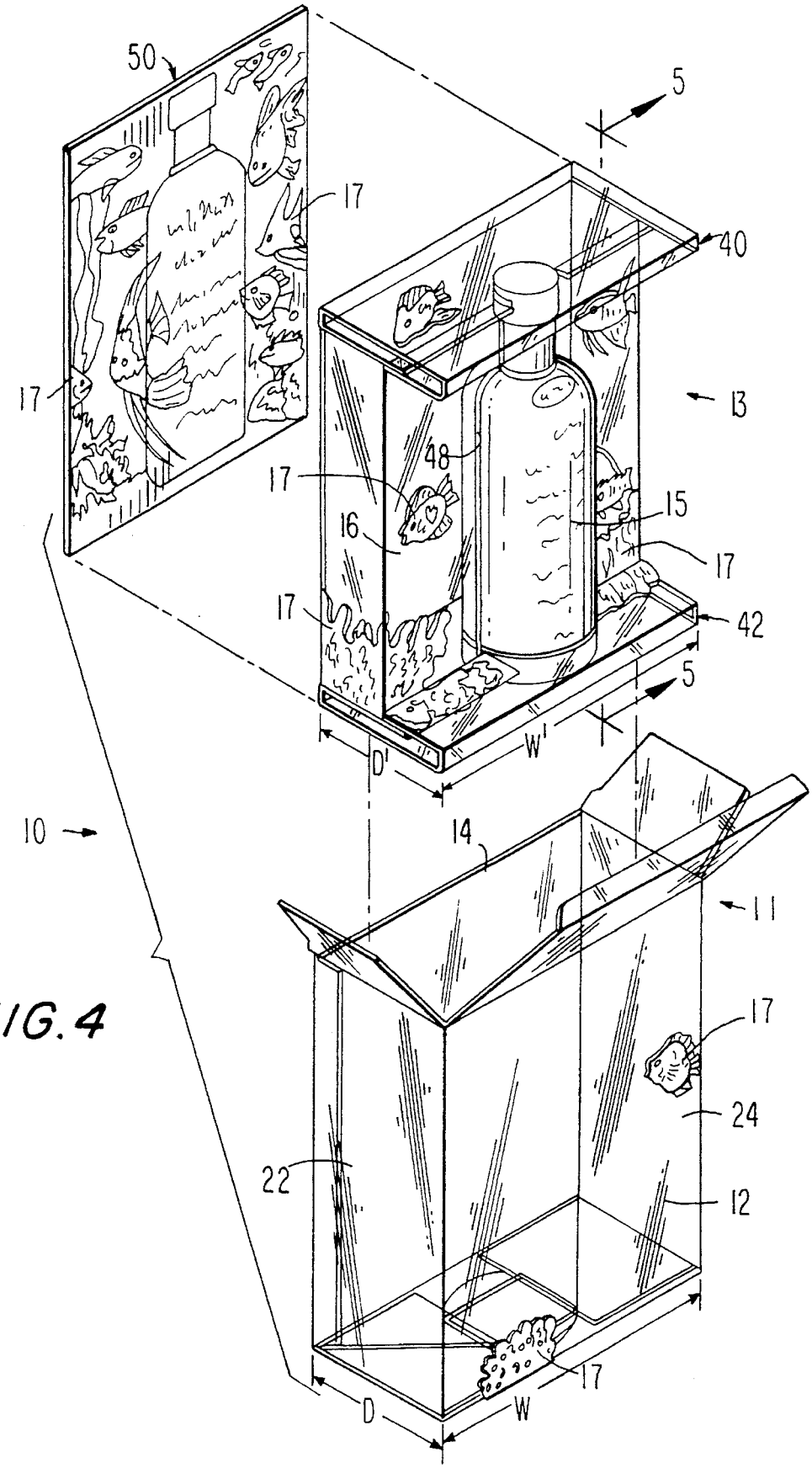
FIG. 4 is an exploded perspective view of the three-dimensional display device in accordance with the invention illustrated in FIGS. 1–3.
Figure 3:
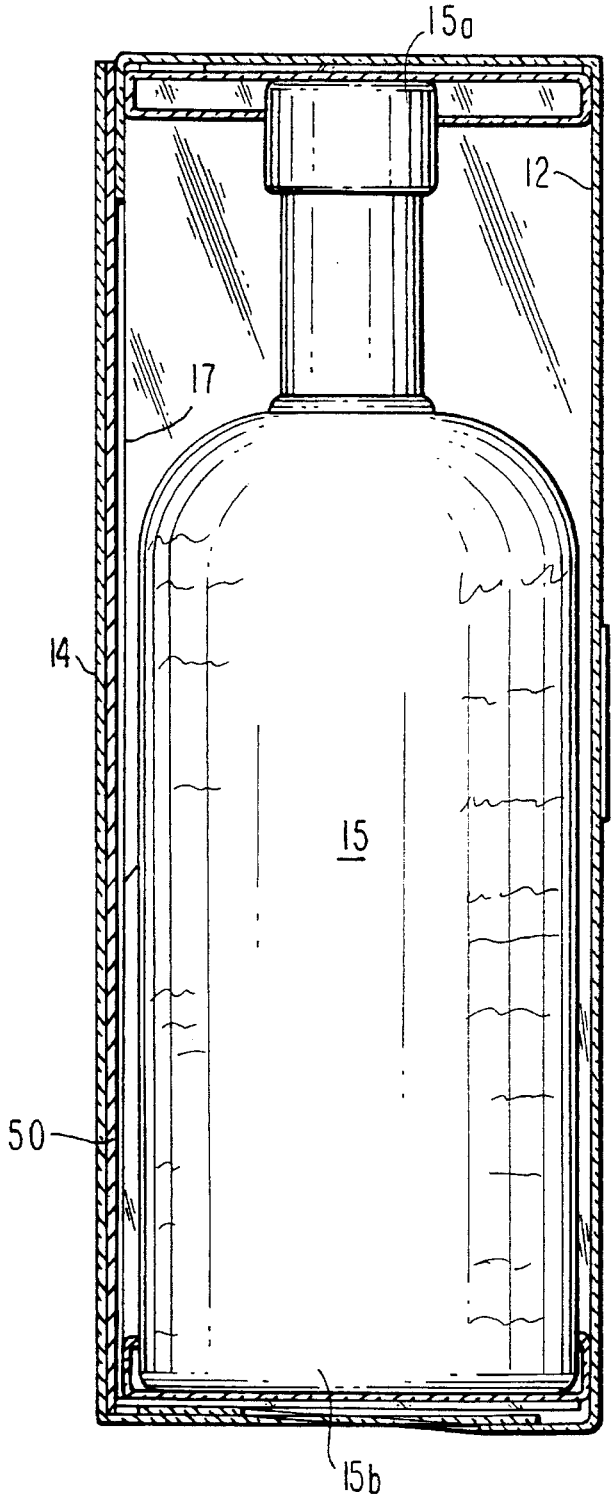
FIG. 3 is a sectional view taken along line 3—3 of FIG. 1.
Figure 5:
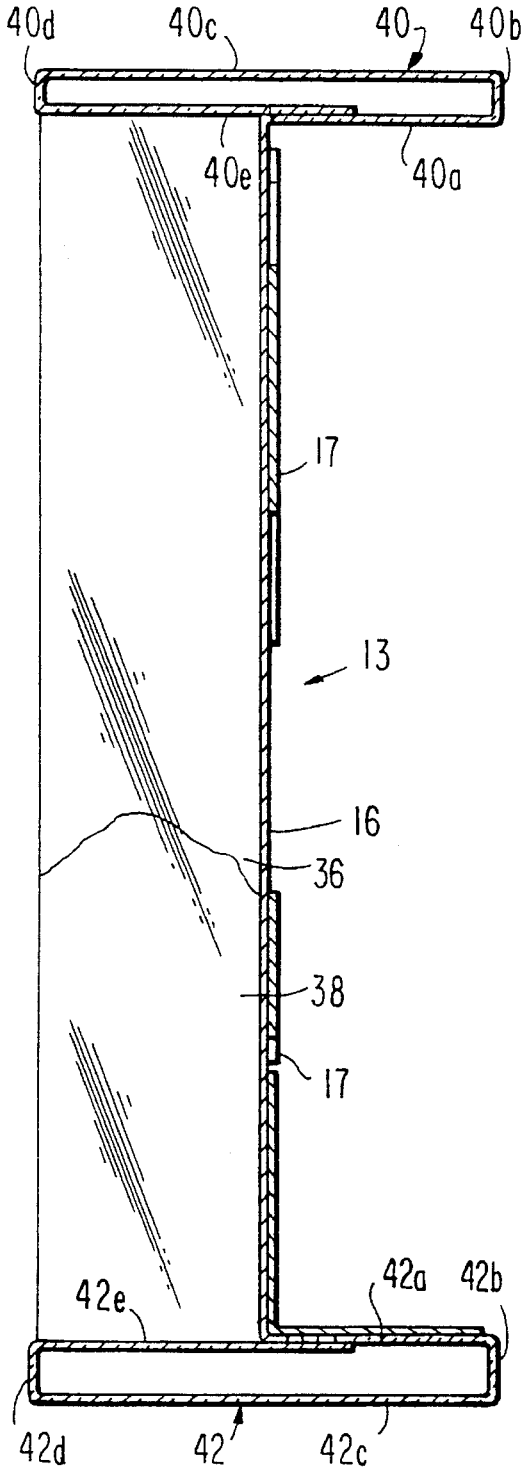
FIG. 5 is a sectional view of the insert member taken along line 5—5 in FIG. 4.
Figure 6:
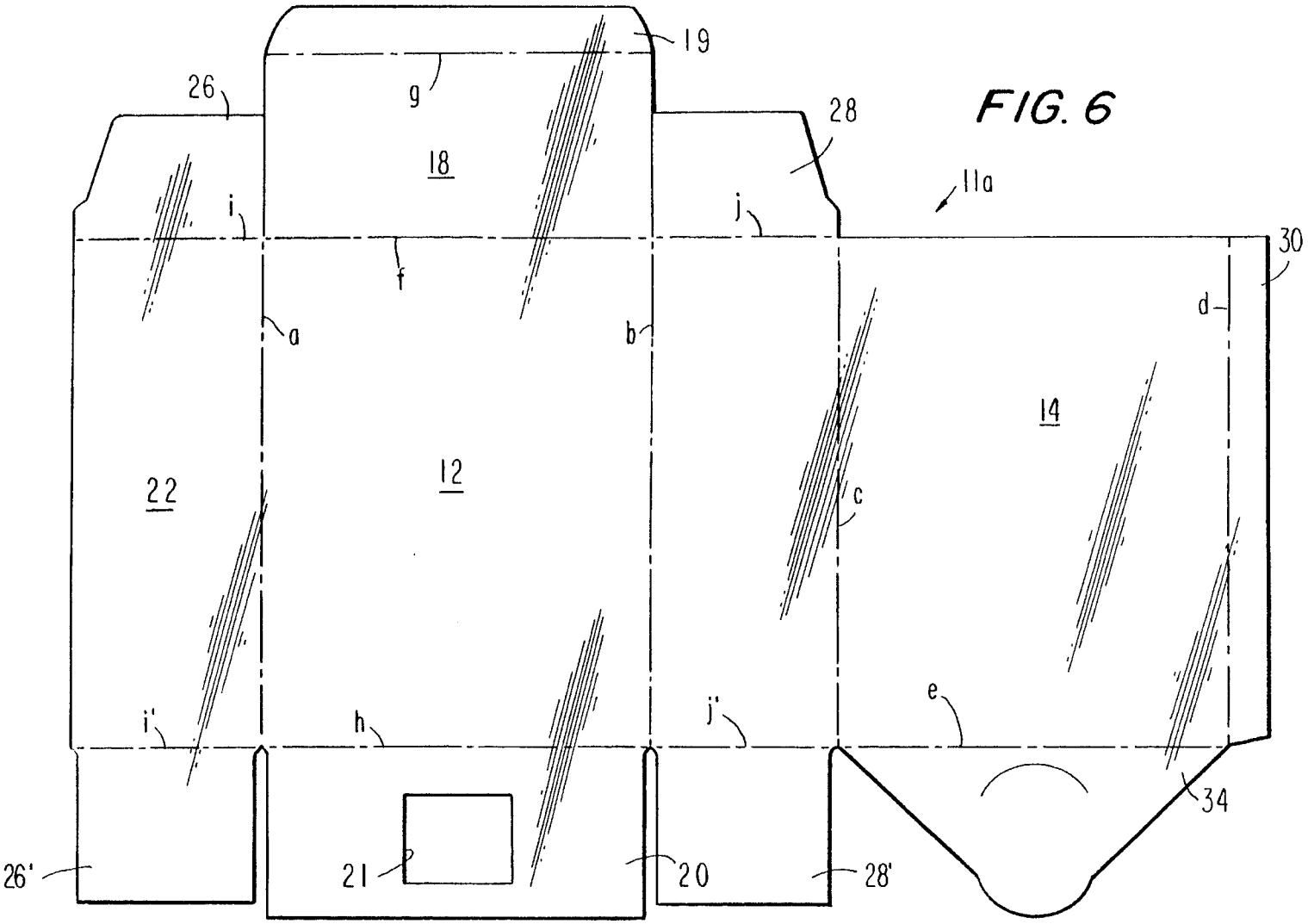
FIG. 6 is a plan view of a blank used in the manufacture of the enclosure member of the three-dimensional display device shown in FIGS. 1–5.

Still referring to FIGS. 1–7, and more particularly to FIG. 6, in accordance with a first embodiment of the invention, the enclosure member 11 is formed from a blank 11*a* of transparent plastic sheet material wherein first and second side walls 22,24 are connected to front wall 12 by fold lines a and b, rear wall 14 is connected to second side wall 24 by a fold line c, and flanges 30,34 are similarly connected to the side and lower edges of rear wall 14 by fold lines d and e respectively.

Front wall 12 is connected at its upper end to top or cover wall 18 by a fold line f and top wall 18 has tuck tab 19 connected thereto by a fold line g. Bottom wall 20 is similarly connected to the bottom edge of front wall 12 by fold line h and has an opening 21 formed therein. Closure flaps 26,28 are connected to the upper edges of side walls 22,24 respectfully by fold lines I and j and closure flaps 26',28' are similarly connected to the lower edges of side walls 22,24 respectfully by fold lines I' and j'.

Figure 7:
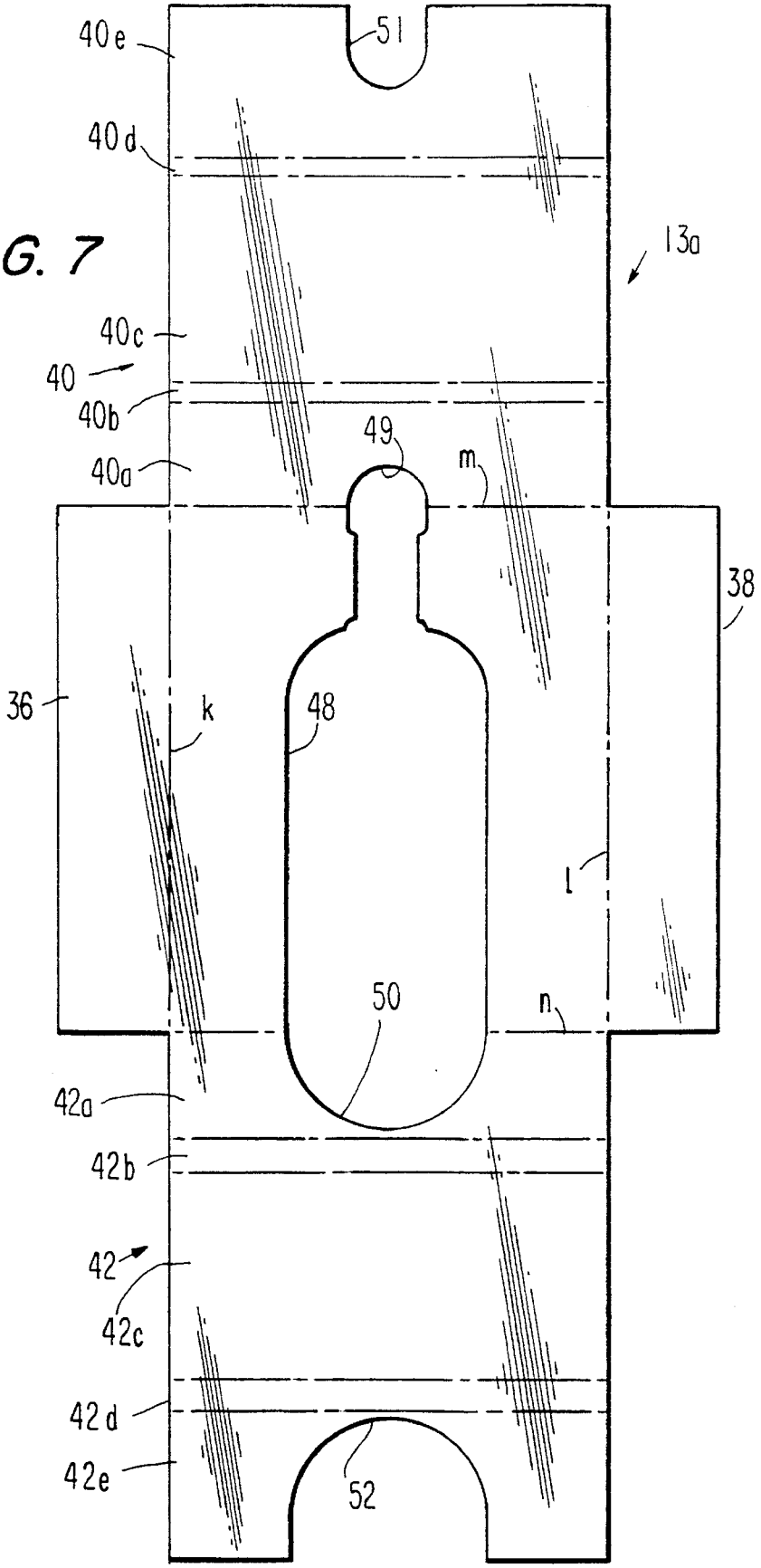
FIG. 7 is a plan view of a blank used in the manufacture of the insert member of the three-dimensional display device shown in FIGS. 1–5.

Referring to FIGS. 4, 5 and 7, the insert member 13 is formed from a unitary blank 13*a* of transparent plastic sheet material and comprises a display wall 16 having a pair of rearwardly extending side panels 36, 38 connected to the side edges of display wall 16 at fold lines k and l, and upper lower flange portions 40 and 42 connected to the upper and lower edges of display wall 16 by fold lines m and n. Flange portions 40, 42 comprise respectively interconnected panels 40*a*, 42*a* extending from fold lines m, n, narrow panels 40*b*, 42*b*, panels 40*c*, 42*c*, narrow panels 40*d*, 42*d* and panels 40*e*, 42*e*.

The enclosure member 11 and insert member 13 are each made of one integral sheet of transparent polymeric material, such as a sheet of rigid polyvinyl chloride having a high impact resistance and a thickness in the range of between 6–28 millimeters. Any rigid or semi-rigid plastic material such as Mylar, polyethylene, polystyrene, or the like, may be used.

Enclosure member 11 is formed from the blank 11*a* of FIG. 6 as follows. The blank 11*a* is folded on the fold lines such that side walls 22,24 are parallel to each other and front wall 12 is parallel to rear wall 14. Flange 30 is folded into face-to-face contact with side wall 22 and is bonded, as for example by an adhesive or thermoplastic coating, to side wall 22. Bottom wall 20 and flange 34 are folded inward perpendicular to front wall 12 and rear wall 14, respectively, and flange 34 is inserted into an opening 21 formed in bottom wall 20 Closure flaps 26,28,26' 28' are folded inward perpendicular to side walls 22,24 (not shown). Top or closure wall 18 is readily capable of being opened and closed to provide access to the inside of enclosure member 11. The enclosure member 11 thus comprises a rectangular parallelpiped having a width W and depth D as seen in FIG. 4.

The blank 13*a* is formed into insert member 13 by folding back side panels 36,38 perpendicular to display wall 16. Upper and lower flange portions 40, 42 are formed by folding panels 40*a*, 42*a* to extend forwardly from fold lines m, n, folding narrow panels 40*b*, 42*b* to face forwardly, folding panels 40*c*, 42*c* rearwardly from panels 40*b*, 42*b*, folding narrow panels 40*d*, 42*d* to face rearwardly, and folding panels 40*e*, 42*e* forwardly from panels 40*d*, 42*d*. As seen in FIG. 4, the flange portions 40, 42 are rectangular in shape having widths W' and depth D' that correspond to the width W and depth D of enclosure member 11 so as to snugly fit with the interior thereof.

The insert member 13 has a cutout 48 shaped to receive a liquor bottle 15 formed over the height of the display wall including portions 49, 50 extending into the panels 40*a*, 42*a* of flange portions 40, 42. Cutouts 51, 52 formed in panels 40*e*, 42*e* correspond in shape to cutout portions 49, 50. Cutouts 49, 51 in upper flange 40 cooperate to receive and hold the closure cap 15*a* of bottle 15 while cutouts 50, 52 in lower flange portion 42 cooperate to receive and hold the bottom end 15*b* of bottle 15. Cutouts 48 (including cutout portions 49, 50) , 51 and 52 thus cooperate to comprise means for associating a product (bottle 15) with the insert member 13.

In accordance with an important aspect of the invention, interrelated foreground, mid-ground and background graphics 17 are provided on front enclosure member wall 12, intermediate insert member display wall 16 and rear enclosure member wall 14 respectively such that the bottle 15, when associated with the insert member 13, appears to be situated in a unitary three-dimensional scene with scenery situated forwardly and rearwardly of the bottle, as well as in the same plane as the bottle. Any scene can be created by graphics 17. The scene shown in the preferred embodiment comprises an underwater environment. To enhance this effect, graphics can also be provided on side walls 22,24 such that the device can also be viewed from the side without losing the three-dimensional effect. The graphics 17 in the illustrated embodiment comprise decals of fish, coral and other underwater objects applied to the front enclosure member wall 12 and the intermediate insert member display wall 16. The graphics are applied to the rear enclosure member wall 14 by means of backing sheet 50 formed of paperboard, cardboard or other inexpensive opaque sheet material which is printed with underwater scenery constituting the background of the three-dimensional scene and associated with the rear wall. The graphics may also be applied using other techniques such as air knife, gravure, silk screening, hot stamping, offset printing and the like.

In assembly, the bottle 15 is associated with insert member 13 which is then inserted into the enclosure member 11. Backing sheet 50 is applied to the rear wall 14 and decals 17 are applied to the intermediate and front walls 16 and 12. Flange portions 40, 42 function to structurally reinforce and fixedly position the display wall 16 within enclosure 11 by virtue of their corresponding width and depth dimensions.

The bottle 15 thus appears to be situated in an underwater environment with fish swimming in front of it (decals on front wall 12), in back of it (graphics on backing sheet 50) and in the same mid-ground region as that in which it is estimated (decals on display wall 16).

Thus, it will be seen that display device 10 provides an attractive means of exhibiting bottles and other products by placing the product within a three-dimensional scene. The device can be placed on shelves or in store windows for display purposes or may be used as a storage or shipping container.

Figure 8:
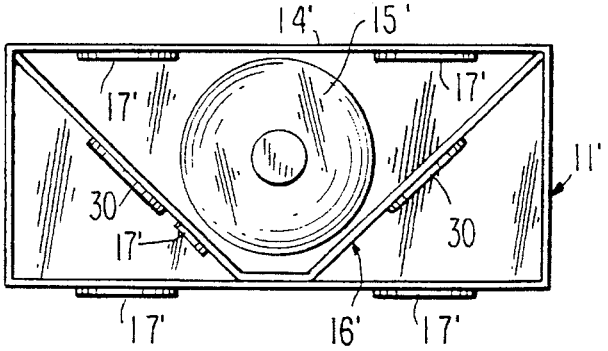
FIG. 8 is a top schematic view of a second embodiment of the invention.

It will be understood that the invention can be embodied in various forms. For example, a product such as a liquor bottle can be held within the enclosure between the intermediate and rear walls, while related products, such as coasters, are associated with the intermediate display wall, such as by adhesive. Thus, referring to FIG. 8 a transparent intermediate display wall 16' situated within a transparent enclosure member 11' may have a V-shaped configuration. Graphics 17' are applied to the front, intermediate and rear walls and the product. A liquor bottle 15' is affixed within enclosure 11' between display wall 16' and rear wall 14'. Coasters 30 are adhesively associated with display wall 16' and may be shaped to have the same unified theme as graphics 17' such as in the shape of a fish.

Figure 9:
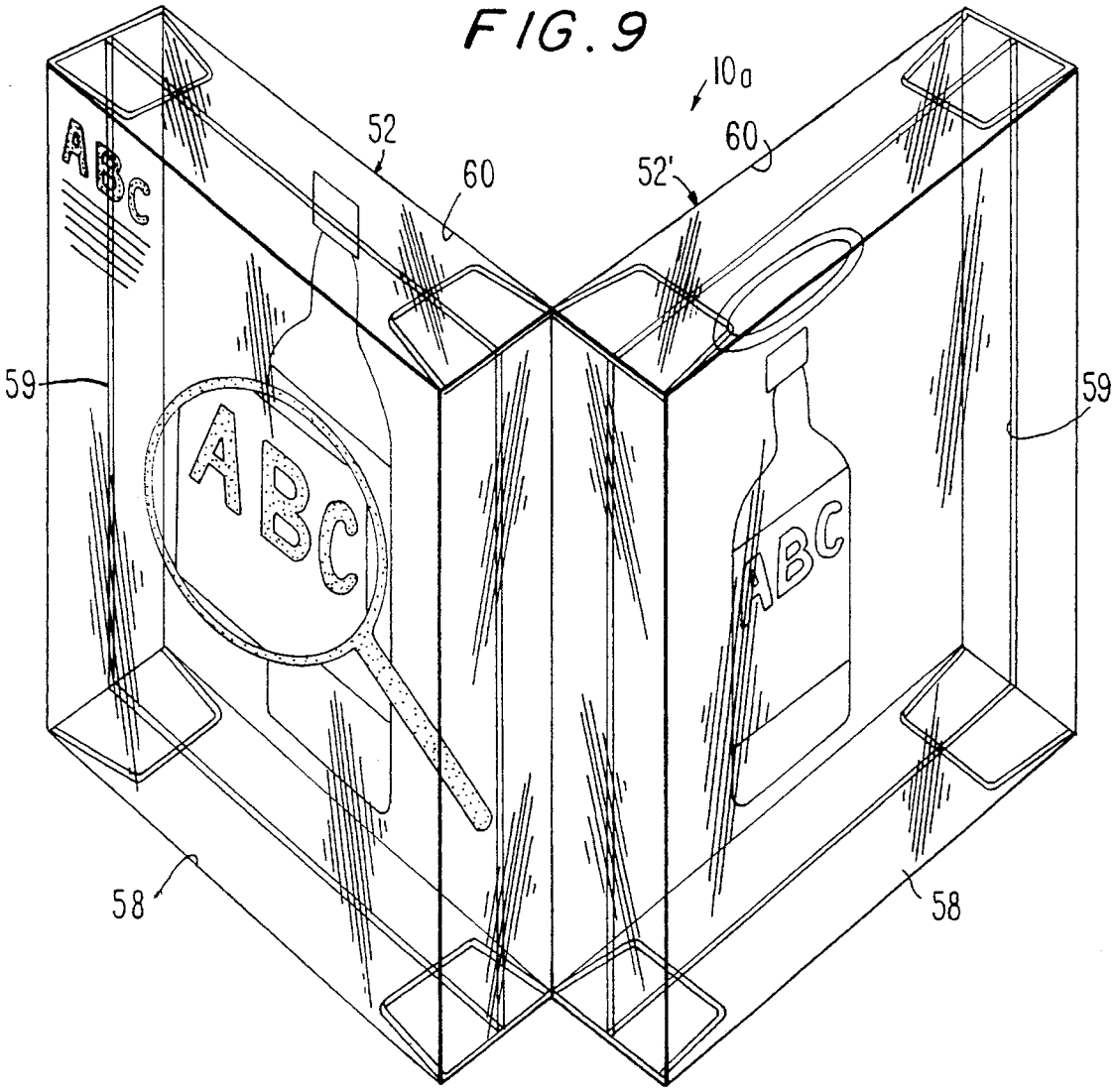
FIG. 9 is a perspective view of a third embodiment of the present invention.

In FIG. 9, a third embodiment of the invention is illustrated wherein a display device **10*a* comprises two rectangular enclosure members 52,52' hingedly joined along edges of respective side walls. Each enclosure member 52,52' is formed of transparent plastic sheet material and includes transparent front wall 58 and rear wall 60. Insert members 59 comprise sheets of transparent plastic material fixed at their edges to the inner peripheries of each enclosure member between front and rear walls 58, 60. In this embodiment, an image 61 of a bottle of liquor, rather than the bottle itself, is applied to the rear wall of each insert member. Graphics 63 having a unified theme are affixed to the front, intermediate display and rear walls 58, 59, and 60 so that the image 61 of the liquor bottle appears to be situated within a three-dimensional scene. As shown in FIG. 9, the scene can be different from that of the preferred embodiment. For example, in enclosure member 52 an image of a bottle is printed on the rear wall and an image of a magnifying glass depicting the label of the bottle in an enlarged state is printed on the display wall. Similarly, in enclosure member 52' the image of a bottle is printed on the rear wall and a halo is printed on the display wall so to appear hovering over the bottle. The device 10*a*** is particularly useful as a table-tent type of promotion for the product whose image is depicted on the display wall. The use of an image of the product rather than the product itself allows the device to be produced in various sizes. The image may be "oversized" enabling the device to be used in a window display. In the alternative, the image may be "miniature" enabling the device to be used as a table centerpiece.

Figure 10:
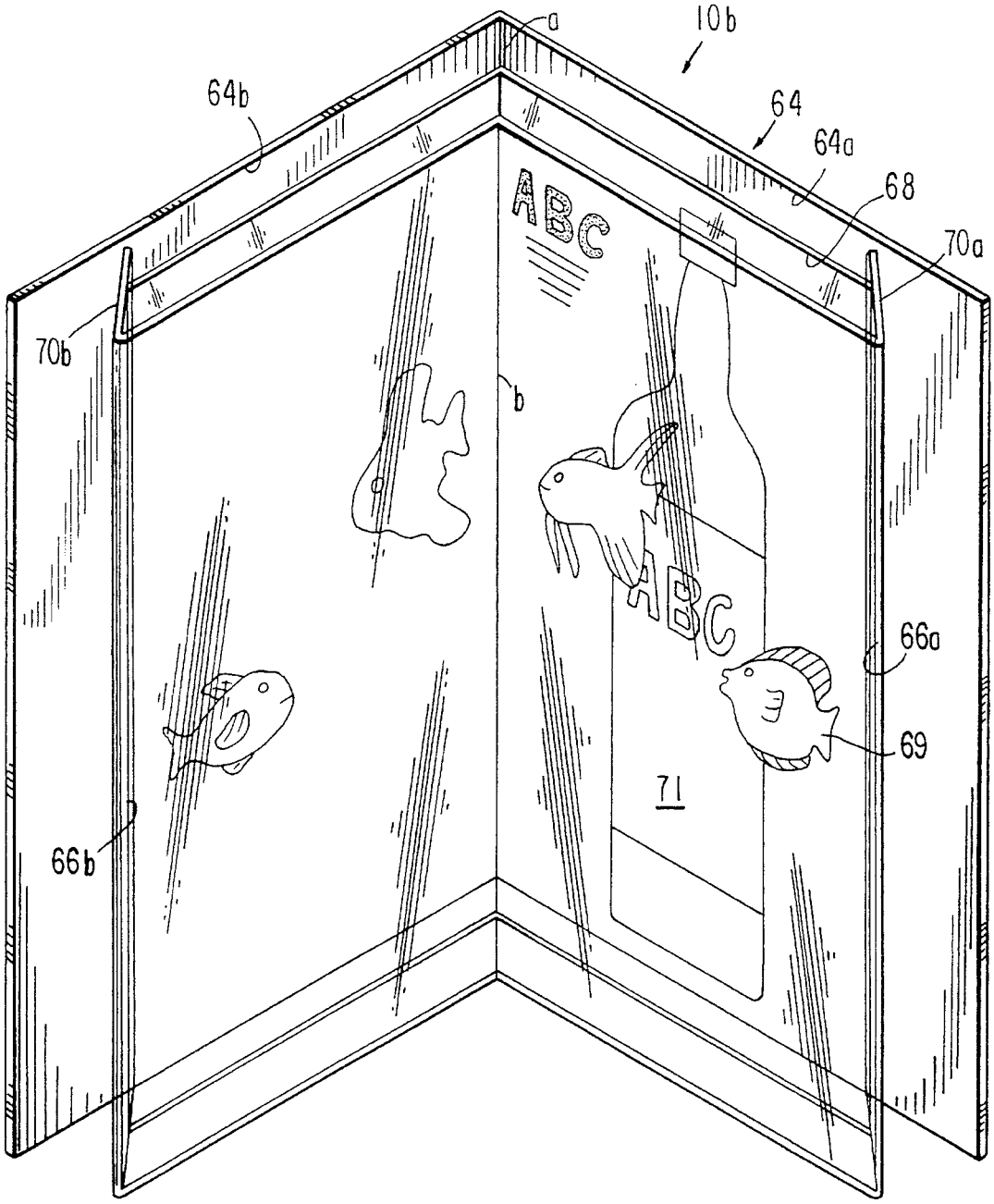
FIG. 10 is a perspective view of a fourth embodiment of the present invention.

In FIG. 10, a fourth embodiment of the invention is illustrated wherein the display device **10*b* comprises a V-shaped construction constituted by a sheet 64 of opaque board material folded at fold line a to form a pair of rear wall sections 64*a* and 64*b*, a sheet of 66 of transparent plastic material folded at fold line b to form a pair of front wall sections 66*a*, 66*b* in opposed relatively to rear wall sections 64*a* and 64*b*, and a sheet of transparent plastic material constituting a display wall 68 situated intermediate the front and rear wall sections 64*a* and 66*a*. The transparent sheet 66 is affixed to the opaque sheet 64 at side section 70*a*, 70*b* of sheet 66. A product or product image 71 is associated with the rear wall section 64*a* and unified graphics 69 are provided on wall sections 64*a*, 66*a* and display wall 68. In the illustrated embodiment, an intermediate display wall is not provided between wall sections 64*b*, 66*b* but may be if so desired. The formation of the rear wall 64** from an opaque material provides the entire device with a rigidity not found in the prior embodiment causing the device of this embodiment to be less expensive to produce. Similar to the device of the prior embodiment, this device is best suited for a table-tent display in a window or on a store room floor.

Figure 11:
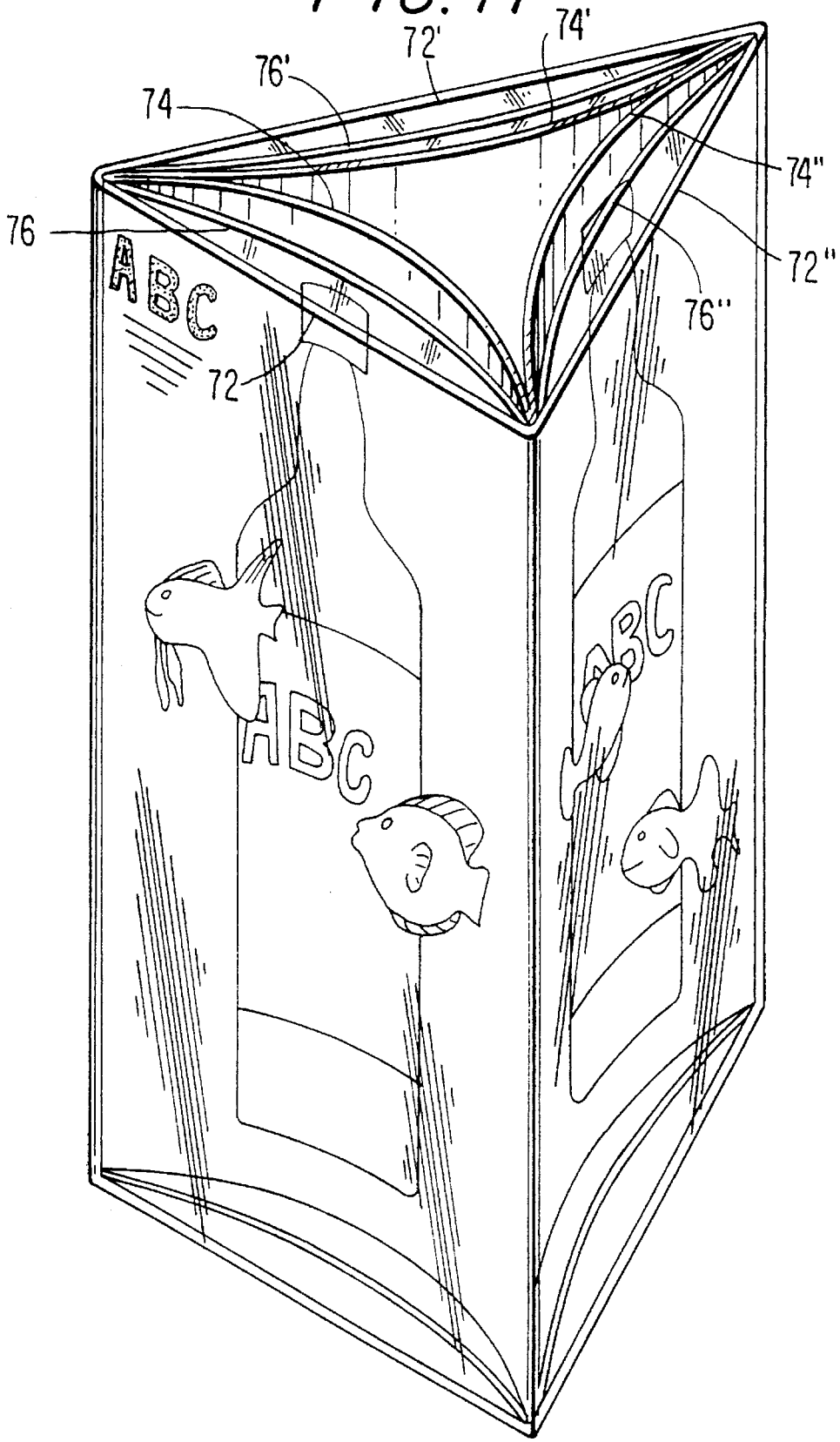
FIG. 11 is a perspective view of a fifth embodiment of the present invention.

In FIG. 11, there is illustrated a fifth embodiment of the present invention wherein the display device is a triangular structure having three front walls 72,72',72" forming a triangular parallelpiped, three concave rear walls 74,74',74" in opposed relationship to respective front walls 72,72',72" and three display walls 76,76',76" located intermediate front walls 72,72',72" and rear walls 74,74',74". Rear walls 74,74', 74" are formed of an integral piece of rigid sheet material similar to backing sheet 50 of display device 10 Front walls 72,72',72" and display walls 76,76',76" are formed of a transparent material sheet similar to the material of enclosure member 11 of display device 10. In this embodiment, graphics are printed on the outer surfaces of each front, rear and display wall to create a three-dimensional scene. Similar to the previous embodiments, the device of this embodiment can comprise either an image of the product printed on the rear walls (as shown in the figure) or the product itself situated within an opening in the display wall. Due to its triangular structure, the three-dimensional effect can be achieved by viewing the device from any direction. Thus, the device of this embodiment is most effective when used for display purposes in the center of a store.

Figure 12:
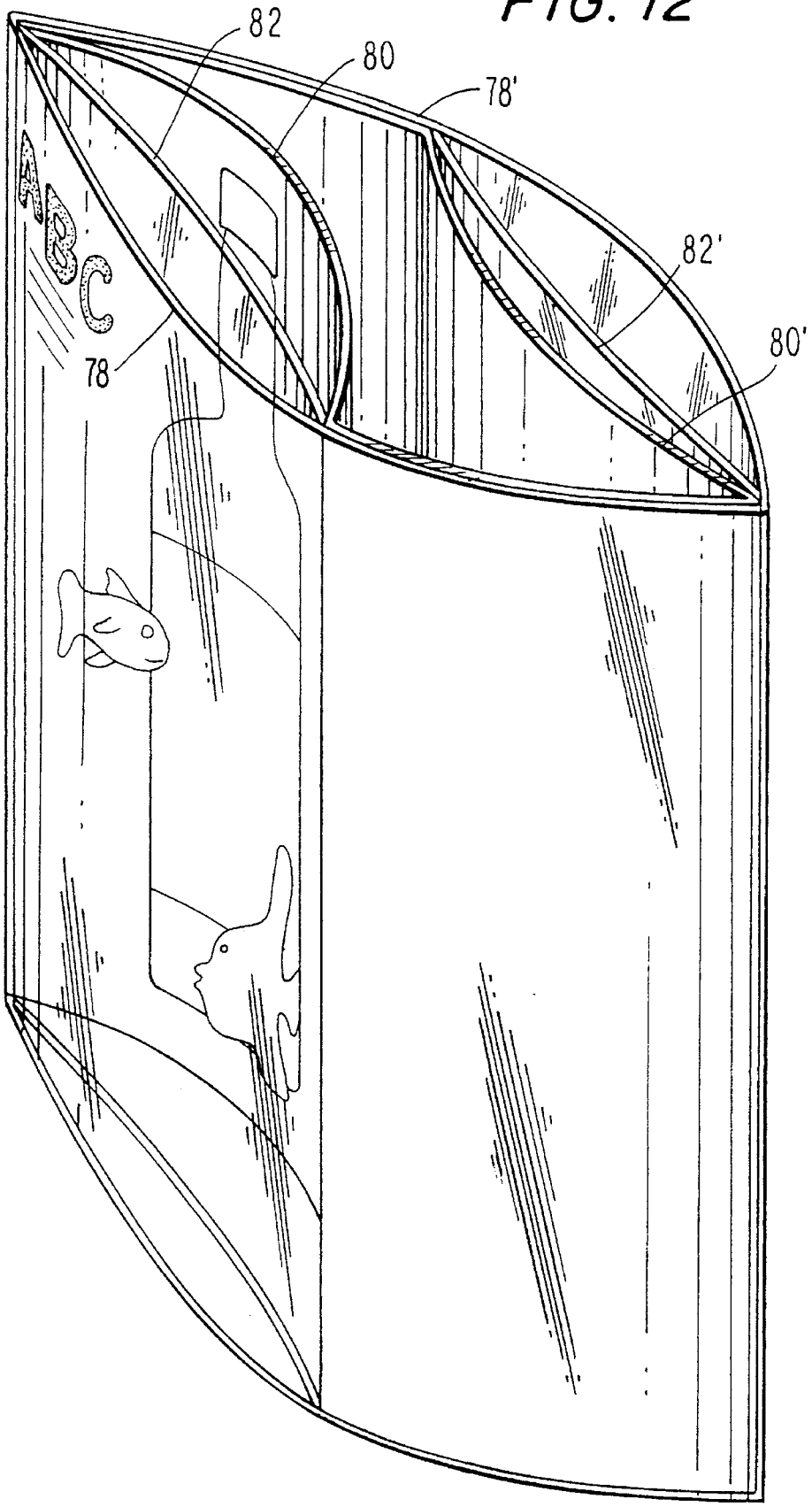
FIG. 12 is a perspective view of a sixth embodiment of the present invention.

In FIG. 12, there is illustrated a sixth embodiment of the present invention wherein the display device is a structure having two front walls 78,78' each having an arcuate shape, two rear walls 80,80' of an arcuate shape and two display walls 82,82' of an arcuate shape. Each rear wall is formed of a rigid material similar to backing sheet 50 of display device 10 and each front and display wall is formed of a transparent material similar to that of enclosure member 11 of display device 10. Graphics are printed on the outer surfaces of each front, rear and display wall to create a three-dimensional scene. In this embodiment, the three-dimensional effect is achieved when the device is viewed from both the front and the rear. In addition to the two three-dimensional areas, the device of this embodiment comprises an opaque surface adjacent to each display area. On these surfaces, the name of the product as well as any slogans or similar information can be printed.

The packaging and display devices disclosed and claimed herein can be place on shelves, or tables, or may be suspended in the form of a promotional dangler. They are suitable for direct mail and other types of promotions.

Obviously, numerous modifications and variations of the present invention are possible in light of the above teachings. It is therefore to be understood that within the scope of the claims appended hereto, the invention may be practiced otherwise than as specifically disclosed herein.

I claim:

1. A display device for a product, comprising:

an enclosure member having an interior defined at least in part by a front wall and a rear wall in opposed relationship thereto, at least said front wall being formed of transparent or translucent material;

an insert member situated in the interior of said enclosure member having a display wall formed of transparent or translucent material situated intermediate of said front wall and said rear wall, said insert member having means for associating a product therewith; and foreground, background and mid-ground interrelated graphics provided on said front, rear and intermediate display wails respectively such that said product, when associated with said intermediate display wall, appears to be situated in a mid-ground region of a unitary three-dimensional display.

2. A display device according to claim 1, wherein said enclosure member comprises a first sheet portion formed of transparent plastic material having panels formed by discrete fold lines which, when said enclosure member is in a set-up condition, define at least said front and rear walls.

3. A display device according to claim 2, wherein said fold lines further form additional panels which, when said enclosure member is in a set-up condition, define a pair of transparent side walls interconnecting said front and rear walls.

4. A display device according to claim 3, wherein said graphics are provided on said side panels consistent with said three-dimensional display.

5. A display device according to claim 1, wherein said insert member comprises a second sheet portion formed of transparent plastic material having panels formed by discrete fold lines which, when said insert member is in a set-up condition, define said intermediate display wall and product-associating means.

6. A display device according to claim 1, wherein said product-associating means of said insert member comprises an opening for receiving and holding at least a portion of said product.

7. A display device according to claim 1, wherein said product-associating means of said insert member comprises tongue sections formed in said intermediate display wall.

8. A display device according to claim 1, wherein said transparent or translucent material is polyvinyl chloride.

9. A display device according to claim 1, wherein said transparent or translucent material has a thickness of about 6 to 28 millimeters.

10. A display device according to claim 1, wherein said rear wall is formed of translucent or transparent material and wherein said display device further includes a backing sheet situated on said rear wall, said background graphics being provided on said backing sheet.

11. A display device according to claim 10, wherein said backing sheet is formed of one of paperboard and cardboard.

12. A display device for one of a product and an image of a product, comprising:

at least one front wall formed of transparent or translucent material;

at least one rear wall in opposed relationship to said at least one front wall;

at least one display wall formed of transparent or translucent material situated intermediate said front and rear walls; and foreground, background and mid-ground interrelated graphics provided on said at least one front, rear and intermediate display walls respectively such that said one of said product and said image of a product, when associated with said at least one front, rear and intermediate display walls, appears to be situated in a unitary three-dimensional environment.

13. A display device according to claim 1, comprising two said enclosure members and insert members situated in said interiors of each of them respectively, each of said enclosure members having a side edge, said enclosure members being hingedly joined together at said side edges thereof.

14. A display device according to claim 12, wherein said at least one rear wall is V-shaped and said at least one front wall comprise two said front walls each having an edge, said front walls being hingedly joined together at said side edges thereof.

15. A display device according to claim 14, wherein said at least one rear wall is formed of one integral piece of paperboard.

16. A display device according to claim 14, wherein said at least one display wall comprises one display wall situated intermediate one of said front walls and said at least one rear wall.

17. A display device according to claim 12, wherein said at least one front wall comprises three front walls, each said front wall having outer edges, joined together at said edges to form a triangular enclosure and wherein said at least one rear wall comprises three rear walls situated within said triangular enclosure.

18. A display device according to claim 17, wherein said three front walls form an equilateral triangle.

19. A display device according to claim 17, wherein said at least one front wall is formed from one integral piece of transparent plastic material and wherein said at least one rear wall is formed on one integral piece of paperboard.

20. A display device according to claim 12, wherein said at least one front wall is comprised of two front walls each having two edges and wherein said edges of one of said front walls are joined to the edges of said other front wall to form two arcuate front walls and wherein said at least one inner wall is comprised of two arcuate members formed from paperboard.

* * * * *